US005621919A

United States Patent [19]

Graham

[11] Patent Number: 5,621,919

[45] Date of Patent: Apr. 22, 1997

[54] HAIR STYLE PROTECTION DEVICE

[76] Inventor: Sandra A. Graham, 124 Connecticut, Highland Park, Mich. 48203

[21] Appl. No.: 503,034

[22] Filed: Jul. 17, 1995

Related U.S. Application Data

[63] Continuation of Ser. No. 228,112, Apr. 15, 1994, abandoned.

[51] Int. Cl.[6] ..... A42B 1/04

[52] U.S. Cl. ..... 2/174; 2/171; 2/207; 132/274

[58] Field of Search ..... 2/174, 171, 207, 2/DIG. 11, 918; 132/274; D2/865, 867, 875, 877, 878, 880, 881

[56] References Cited

U.S. PATENT DOCUMENTS

| | | | |
|---|---|---|---|
| D. 277,330 | 1/1985 | Wasson . | |
| 1,633,586 | 6/1927 | Hunter . | |
| 1,652,933 | 12/1927 | Caskell . | |
| 1,897,146 | 2/1933 | Richardson . | |
| 1,991,982 | 2/1935 | Hodges . | |
| 2,051,384 | 8/1936 | Lipton . | |
| 2,174,263 | 9/1939 | Guglielmi . | |
| 2,175,849 | 10/1939 | Oliner | 132/274 |
| 2,560,267 | 7/1951 | Baker et al. . | |
| 2,700,977 | 2/1955 | Neerup . | |
| 2,996,724 | 8/1961 | Rose et al. . | |
| 3,131,400 | 5/1964 | Blanchard et al. . | |
| 3,357,027 | 12/1967 | Feil . | |
| 4,277,847 | 7/1981 | Florio . | |
| 4,394,782 | 7/1983 | Wasson . | |
| 4,698,852 | 10/1987 | Romero . | |
| 4,776,042 | 10/1988 | Hanson et al. . | |
| 4,964,175 | 10/1990 | Taylor | 2/174 |
| 5,161,260 | 11/1992 | Reynolds | 2/207 |

FOREIGN PATENT DOCUMENTS

| | | |
|---|---|---|
| 7714255 | 8/1978 | France . |
| 462984 | 4/1951 | Italy . |

OTHER PUBLICATIONS

The Company Store, 500 Company Store Road, La Crosse, WI 54601; Item H–Style L105–F28.

*Primary Examiner*—Diana Biefeld
*Attorney, Agent, or Firm*—Harness, Dickey & Pierce, P.L.C.

[57] ABSTRACT

A convenient hair wrap is provided which covers the rear portion of the head and allows for retention of the hair at that portion to retain a hair style or the like, and is easily positionable and securable on a wearer's head. Additionally, the hair wrap provides an aesthetically pleasing hair cover which may be worn out in public and still present a fashionable look.

10 Claims, 2 Drawing Sheets

HAIR STYLE PROTECTION DEVICE

This is a continuation of U.S. patent application Ser. No. 08/228,112, filed Apr. 15, 1994, and now abandoned.

BACKGROUND OF THE INVENTION

The present invention relates to a head wrap member which assists in retention of hair styles during sleeping and other activities. More specifically, the present invention relates to a hair wrap type device which is easily adjustable and comfortable to wear while protecting the cosmetics of various hair styles.

In the past, there have been various devices for protecting hair styles and the like during various activities. These have included bonnets which are triangular shaped and formed of various fabrics and plastics such as rain bonnets which include elongated strips which tie underneath the chin. While these are affective in some matters, they do not hold hair styles in place and have several complications such as not staying in position on the head readily, the ties may untie, and generally are not thought of as attractive. In recent years, there have been other wrap designs including hair net type designs which encircle the whole head and include elastic at the base for securement of the net on top of the head. These are, again, not aesthetically pleasing and are subject to becoming out of position on a person's head.

A third type of hair covering device is also known wherein the device is similar to a bonnet type in that it is a triangular piece of fabric with two elongated strips which can be tied. In this particular device, the strips are wrapped about the forehead and a bow or other type of knot is tied atop the forehead to secure the device. While such a device in theory seems practical, it has been found that tieing an aesthetically pleasing knot while keeping the desired hair style intact, is an extremely burdensome task. Furthermore, even the best tied knots seem to come undone in such hair covering devices and the hair cover easily shifts.

Therefore, there remains a goal in the art to provide a convenient hair wrapping device which provides the desirable amount of hair retention without the complications described above. Thus, a desirable hair wrap device would be aesthetically pleasing, would not easily come off, and would be highly adjustable and easy to use and wear.

SUMMARY OF THE INVENTION

In accordance with the present invention there is provided a hair wrap for covering strands of hair and maintaining their condition. The hair wrap of the present invention includes a fabric cover for covering strands of hair, primarily in the rear portion of the head. The cover has an outer decorative surface and an inner surface for engaging the hair. Extending from the fabric cover is a wrap member having a length sufficient to encircle the head of a user. The wrap member would include a free end which is juxtapositioned over a securing area upon the decorative outer surface when the wrap is positioned in the operative position. The outer surface includes a first portion of a hook and loop type fastening device which is attached to the securing area upon the decorative outer surface of the cover member, with the first portion of the hook and loop fastener outwardly exposed. A second portion of the hook and loop fastener is attached to the inner surface of the wrap member near a free end for engaging the first portion of the hook and loop fastener, whereby the wrap member conceals the first and second portions of the hook and loop fastener when in the operative position, i.e. wrapped about a person's head. Also in accordance with the present invention, a second wrap member with a hook and loop fastener can also extend from the fabric cover opposite the first wrap member so that the two wrap members can criss cross over the forehead of the user in a decorative fashion.

Thus, in accordance with the present invention, a convenient wrap is provided which covers the rear portion of the head and allows for retention of the hair at that portion to retain a hair style or the like, and is easily positionable and securable on a wearer's head. Additionally, the present wrap provides an aesthetically pleasing hair cover which may be worn out in public without embarrassment.

Additional objects, advantages, and features of the present invention will become apparent from the following description and accompanying claims, when taken in conjunction with the accompanying drawings.

BRIEF DESCRIPTION OF THE DRAWINGS

FIG. 6 is a perspective view of the wrap in place on a person's head (shown in phantom) illustrating a pocket formed for holding of a hair bun or the like;

DETAILED DESCRIPTION OF THE PREFERRED EMBODIMENTS

Figure 1:
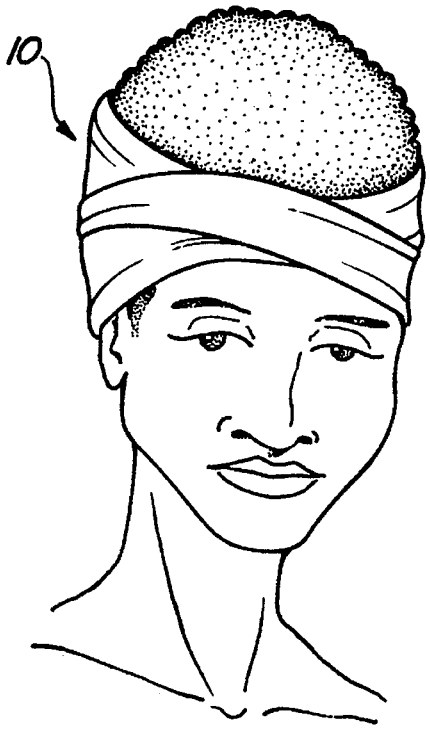
FIG. 1 is a prospective view showing the wrap of the present invention engaged on a persons head.
Figure 2:
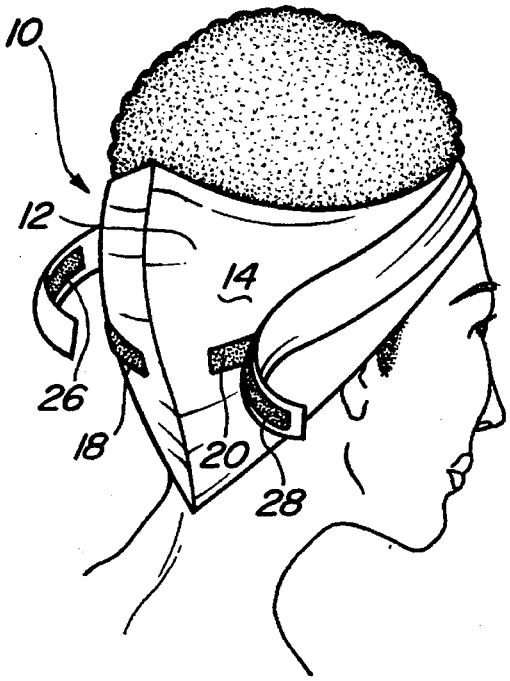
FIG. 2 is a prospective view showing the wrap position on a person's head from a rear view standpoint.
Figure 3:
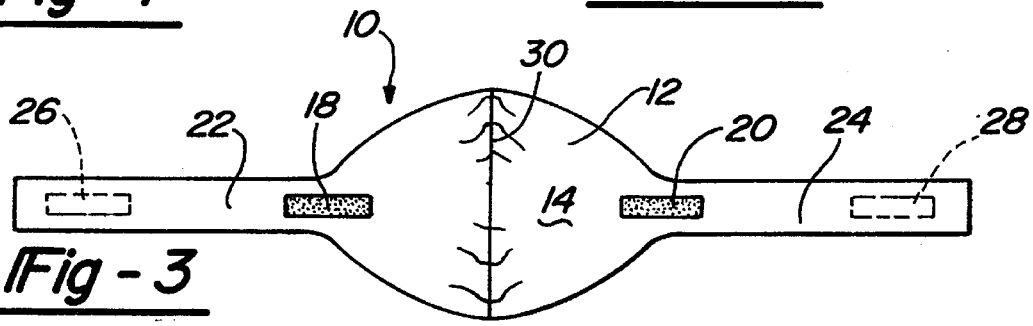
FIG. 3 is a planar view of a wrap in accordance with the present invention in a first embodiment for covering a bun or other large hair style in the rear of a person's head.

Now referring to the figures accordance with the present invention, there is provided a hair wrap apparatus generally indicated at 10. In the specification set forth below, like elements in the various embodiments are set forth with similar numbers differing by a magnitude of 100. The hair wrap 10 includes a fabric cover portion 12. The fabric cover 12 is designed for covering strands of hair at the rear portion of a person's head. This is often desirable in various hair styles, for instance when a woman puts her hair up in a bun or in curlers, a cover may be desirable to retain the bun or curlers. In other cases where hair has been straightened or otherwise styled, for instance short hair having straightened curls or the like, it is desirable to retain it in its configuration during sleeping or other activities such that the hair style retains its configuration for the longest time possible. Thus, each of the embodiments includes a hair cover 12, 112 or 212 for covering portions of the head as desirable in a certain instance. The fabric cover 12 has an outer decorative surface 14 and an inner surface 16 for engaging the hair.

A first portion of a hook and loop fastener is provided on the outer fabric surface for securement. Preferably, a pair of elongated Velcro® strips 18 and 20 are provided. At least one wrap member is provided to be wrapped around the forehead of a person in order to secure the hair wrap on the head. In a preferred embodiment, a pair of wrap members 22 and 24 are provided and are attached to the fabric cover 12. The second portion of a hook and loop fastener is provided adjacent the distal ends of the wrap members. Preferably, a pair of elongated strips of hook and loop fastener material such as Velcro® strips 26 and 28 are provided. The second pair of Velcro® strip fasteners 26 and 28 are provided on the inner surface 16 of the wrap member. Thus, when a Velcro® member 26 is wrapped around the head and engaged with another Velcro® member such as 18, the Velcro® is concealed from view on the hair wrap by the outer surface of the wrap membrane.

Figure 4:
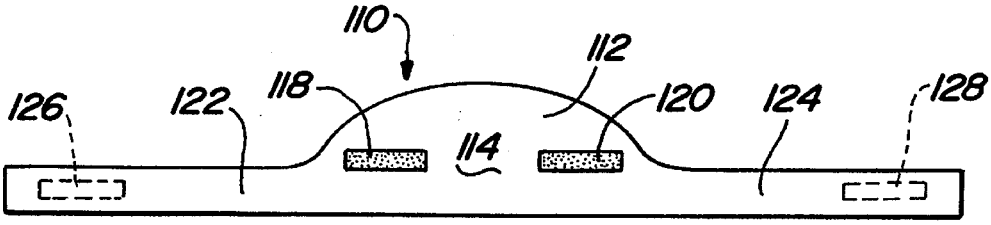
FIG. 4 is a second embodiment of a wrap in accordance with the present invention for less coverage in the rear portion of a person's head.
Figure 5:
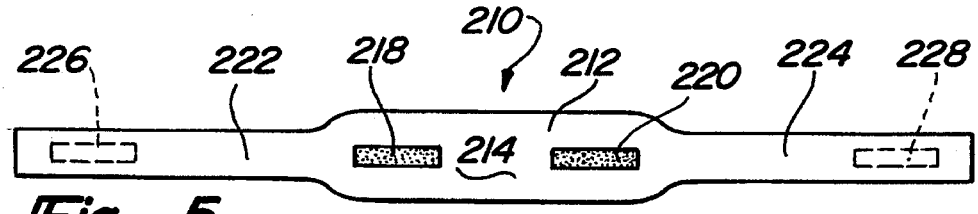
FIG. 5 is a third embodiment of the present invention showing a thinner fabric cover for less coverage in the rear portion of a person's head.
Figure 6:
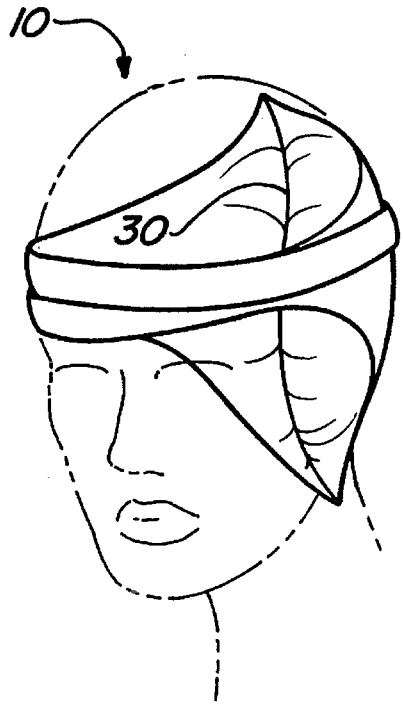
Figure 7:
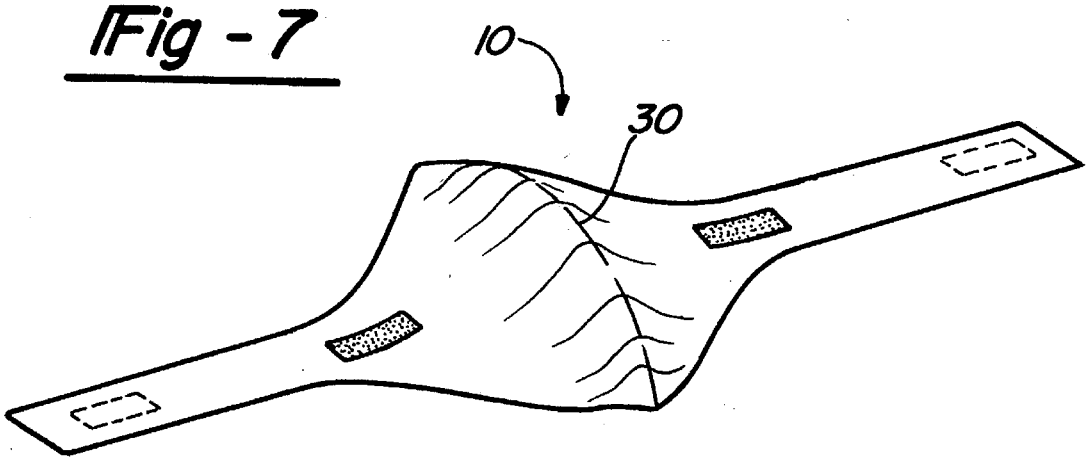
FIG. 7 is a perspective view of the wrap shown in FIGS. 3 and 7.
Figure 8:
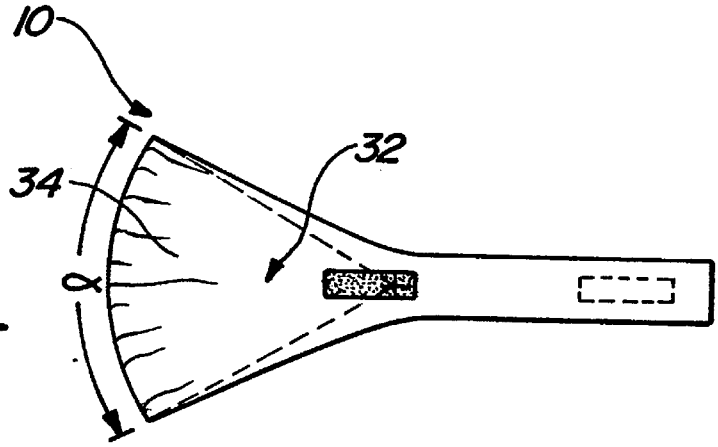
FIG. 8 is a view of the wrap of FIG. 7 folded along a seam.

Shown in FIGS. 1, 2, 3, 6, 7 and 8 is a hair wrap device for retention of a bun, french roll, voluminous hair or the like. In this embodiment, an arcuate seam 30 is created to provide a pocket in the hair wrap for such a hair style. The wrap 10 is thus made of two halves of fabric such as that shown at 32 in FIG. 8 which includes an arcuate end surface 34. The end surface 34 of two such halves 32 are sewn together to provide the final wrap article 10. The arcuate seam 30 has a substantially circular curvature, and sweeps out an angle $\alpha$ of a complete circle, where $\alpha$ is about 60° in this embodiment. Thus, a pocket is formed which is best shown in FIGS. 6 and 7. This allows a bulky hair style to be contained underneath when the wrap is positioned on the head of a user. The cover portion 112 shown in FIG. 4 is made of a one piece satin fabric and is useful for short hair cuts or styles. The cover portion shown in FIG. 5 is useful for a pageboy or bob cut in order to keep the hair at the base of the neck in place.

In operation, the fabric cover is placed behind a person's head and thereafter a first wrap member is wound about the forehead and easily adjusted and secured by use of the elongated Velcro® strips, thus covering the exposed Velcro® strip 18 or 20. Thereafter, a second wrap member can be included which can be criss-crossed with the first wrap member around the front of the head at the forehead and secured towards the back of the head to a Velcro® strip. Thus, when wearing the hair wrap of the present invention, no unsightly fasteners are shown and a comfortable positioning on the head may be obtained. The hair wrap is easily adjusted by utilizing the length of the Velcro® strips. This hair wrap of the present invention is stylish and provides a hair wrap without the inconvenience of having to tie or maintain a knot at the front end, which causes pressure on the forehead and is uncomfortable. The wrap of the present invention is easy to use and maintains forces which allow the wrap to maintain its position on the head without sliding or otherwise moving on the head.

The above description discloses and describes merely exemplary embodiments of the present invention and is described in terms of illustration, rather than limitation. One skilled in the art will readily recognize from the above discussion from the accompanying drawings and claims, that various changes, modifications and variations can be made without departing from the proper scope of the present invention, as defined in the following claims.

What is claimed is:

1. A hair wrap for covering strands of hair, said wrap comprising:

a) a fabric cover for covering strands of hair, wherein the fabric cover is formed from two abutting pieces of cloth sewn together such that a pocket in which to fit a voluminous hair style is formed, said cover having an outer decorative surface and inner surface for engaging said strands of hair, said abutting pieces of cloth forming an arcuate seam having a substantial circular curvature where the arcuate seam sweeps out a radius of curvature of about 60° of a circle;

b) a first wrap member extending from said fabric cover, said wrap member having a length sufficient to encircle a head of a user and a free end which is juxtapositioned over a securing area upon said decorative outer surface when in an operative position;

c) a first portion of a first hook and loop fastener attached to said securing area upon said decorative outer surface of said cover such that said first portion of said hook and loop fastener is outwardly exposed; and d) a second portion of said first hook and loop fastener attached to said first wrap member near said free end for engaging said first portion of said hook and loop fastener, said first wrap member concealing said first and second portions of said first hook and loop fastener when in said operative position.

2. The hair wrap of claim 1, wherein the hair wrap includes a second wrap member extending from said fabric cover opposite of said first wrap member, said second wrap member having a length sufficient to encircle a head of a user and a free end which is juxtapositioned over a securing area upon said decorative outer surface when in an operative position.

3. The hair wrap of claim 2, wherein the second wrap member includes a first portion of a second hook and loop fastener attached to an inner portion of said second wrap member and wherein said securing area upon said decorative outer surface of said cover includes a second portion of said second hook and loop fastener, said wrap member concealing said first and second portions of said second hook and loop fastener when in said operative position.

4. The hair wrap of claim 1, wherein the hair wrap is formed from satin.

5. The hair wrap of claim 1, wherein the hook and loop faster is elongated such that the length of the wrap member sufficient to encircle the head of the user is adjustable.

6. An improved hair wrap having a cover and pocket portion for covering strands of hair and a pair of wrap portions extending from said cover portion for wrapping around a head of a user to secure said cover portion in place upon said head, covering said strands of hair, said improvement comprising pairs of hook and loop fasteners wherein a first pair is attached to an outer surface of said cover portion and a second pair of hook and loop fasteners capable of attaching to the first pair of hook and loop fasteners is attached to an inner surface of said wrap portions, each of said wrap portions having a length sufficient to encircle a portion of said head such that said wrap portions extend from said cover portion, encircle a portion of said head, and said first and second hook and loop fasteners engage one another, said improvement further comprising said cover and pocket portion formed from two abutting pieces of cloth sewn together such that a pocket is formed in which to fit a voluminous hair style, wherein the abutting pieces of cloth form an arcuate seam having a substantial circular curvature where the arcuate seam sweeps out a radius of curvature of about 60° of a circle.

7. The hair wrap of claim 6, wherein the hair wrap is formed from satin.

8. The hair wrap of claim 6, wherein the hook and loop fasteners are elongated such that the lengths of the wrap members sufficient to encircle the head of the user are adjustable.

9. A hair wrap for covering strands of hair, said wrap comprising:

a) a fabric cover for covering strands of hair, wherein the fabric cover is formed from two abutting pieces of cloth sewn together to form an arcuate seam such that a pocket in which to fit a voluminous hair style is formed, said cover having an outer decorative surface and inner surface for engaging said strands of hair, said abutting pieces of cloth forming an arcuate seam having a substantial circular curvature where the arcuate seam sweeps out a radius of curvature of about 60° of a circle;

b) a first and second wrap member extending outwardly from opposite ends of said fabric cover, said wrap members each having a length sufficient to encircle a head of a user and a free end which is juxtapositioned over a securing area upon said decorative outer surface when in an operative position;

c. two first portions of a pair of hook and loop fasteners attached to said securing area upon said decorative outer surface of said cover such that said first portions of said hook and loop fasteners are outwardly exposed; and d. a second portion of said pair hook and loop fasteners attached to said first and second wrap members near said free ends for engaging said first portions of said hook and loop fasteners, said wrap members concealing said first and second portions of said hook and loop fasteners when in said operative position.

10. The hair wrap of claim 9, wherein said two pieces of cloth are each generally Y shaped, wherein said wrap member forms a base arm of the Y shape, and the cover has edges which form a first and second upper arm of the Y shape, and wherein the arcuate seam connects said first and second arms opposite of the base arm.

* * * * *